US008443903B2

(12) United States Patent
O'Connor et al.

(10) Patent No.: US 8,443,903 B2
(45) Date of Patent: May 21, 2013

(54) PUMP DOWN SWAGE EXPANSION METHOD

(75) Inventors: Keven O'Connor, Houston, TX (US); Joerg Lehr, Celle (DE); Mark K. Adam, Houston, TX (US); Ines Gruetzmann, Lehrte-Arpke (DE)

(73) Assignee: Baker Hughes Incorporated, Houston, TX (US)

( * ) Notice: Subject to any disclaimer, the term of this patent is extended or adjusted under 35 U.S.C. 154(b) by 319 days.

(21) Appl. No.: 12/901,122

(22) Filed: Oct. 8, 2010

(65) Prior Publication Data

US 2012/0085549 A1 Apr. 12, 2012

(51) Int. Cl.
*E21B 43/10* (2006.01)

(52) U.S. Cl.
USPC ..... 166/380; 166/207

(58) Field of Classification Search
USPC ..... 166/380, 384, 207
See application file for complete search history.

(56) References Cited

U.S. PATENT DOCUMENTS 6,328,113 B1 12/2001 Cook
6,557,640 B1 5/2003 Cook et al.
6,561,227 B2 5/2003 Cook et al.
6,568,471 B1 5/2003 Cook et al.
6,575,240 B1 6/2003 Cook et al.
6,604,763 B1 8/2003 Cook et al.
6,631,759 B2 10/2003 Cook et al.
6,631,760 B2 10/2003 Cook et al.
6,631,769 B2 10/2003 Cook et al.
6,684,947 B2 2/2004 Cook et al.
6,705,395 B2 3/2004 Cook et al.
6,712,154 B2 3/2004 Cook et al.
6,725,919 B2 4/2004 Cook et al.
6,739,392 B2 5/2004 Cook et al.
6,745,845 B2 6/2004 Cook et al.
6,758,278 B2 7/2004 Cook et al.
6,823,937 B1 11/2004 Cook et al.
6,843,322 B2 1/2005 Burnter
6,857,473 B2 2/2005 Cook et al.
6,892,819 B2 5/2005 Cook et al.
6,966,370 B2 11/2005 Cook et al.
6,968,618 B2 11/2005 Cook et al.
6,976,541 B2 12/2005 Brisco et al.
7,021,390 B2 4/2006 Cook et al.
7,036,582 B2 5/2006 Cook et al.
7,040,396 B2 5/2006 Cook et al.
7,044,218 B2 5/2006 Cook et al.
7,044,221 B2 5/2006 Cook et al.
7,048,067 B1 5/2006 Cook et al.
7,055,608 B2 6/2006 Cook et al.

(Continued)

OTHER PUBLICATIONS

Nowlin, Jr., W.D., et al., "Overview of Classes of Currents in deep water region of the Gulf of Mexico", OTC 12991, Apr. 2001, 1-7.

*Primary Examiner* — William P Neuder
(74) *Attorney, Agent, or Firm* — Steve Rosenblatt

(57) ABSTRACT

The tubular string to be expanded is run in on a running string. The swage assembly has a seal from the running string to the existing tubular and the top of the tubular string to be expanded also has a similar seal against the exiting tubular. Annulus pressure around the running string drives the swage assembly to support the expanded tubular to the exiting tubular and to continue expansion to the end of the tubular. Cementing then takes place followed by reconfiguring the swage assembly to engage the liner hanger seal with the result being a monobore connection in a single trip including the cementing.

23 Claims, 21 Drawing Sheets

U.S. PATENT DOCUMENTS

| | | | | |
|---|---|---|---|---|
| 7,063,142 | B2 | 6/2006 | Cook et al. | |
| 7,077,211 | B2 | 7/2006 | Cook et al. | |
| 7,077,213 | B2 | 7/2006 | Cook et al. | |
| 7,100,684 | B2 | 9/2006 | Cook et al. | |
| 7,100,685 | B2 | 9/2006 | Cook et al. | |
| 7,108,061 | B2 | 9/2006 | Cook et al. | |
| 7,108,072 | B2 | 9/2006 | Cook et al. | |
| 7,121,337 | B2 | 10/2006 | Cook et al. | |
| 7,121,352 | B2 | 10/2006 | Cook et al. | |
| 7,146,702 | B2 | 12/2006 | Cook et al. | |
| 7,147,053 | B2 | 12/2006 | Cook et al. | |
| 7,159,665 | B2 | 1/2007 | Cook et al. | |
| 7,159,667 | B2 | 1/2007 | Cook et al. | |
| 7,168,499 | B2 | 1/2007 | Cook et al. | |
| 7,172,019 | B2 | 2/2007 | Cook et al. | |
| 7,172,021 | B2 | 2/2007 | Brisco et al. | |
| 7,172,024 | B2 | 2/2007 | Cook et al. | |
| 7,174,964 | B2 | 2/2007 | Cook et al. | |
| 7,185,710 | B2 | 3/2007 | Cook et al. | |
| 7,195,061 | B2 | 3/2007 | Cook et al. | |
| 7,195,064 | B2 | 3/2007 | Cook et al. | |
| 7,198,100 | B2 | 4/2007 | Cook et al. | |
| 7,201,223 | B2 | 4/2007 | Cook et al. | |
| 7,204,007 | B2 | 4/2007 | Cook et al. | |
| 7,216,701 | B2 | 5/2007 | Cook et al. | |
| 7,231,985 | B2 | 6/2007 | Cook et al. | |
| 7,234,531 | B2 | 6/2007 | Kendziora et al. | |
| 7,240,728 | B2 | 7/2007 | Cook et al. | |
| 7,240,729 | B2 | 7/2007 | Cook et al. | |
| 7,240,731 | B2 | 7/2007 | Carmody et al. | |
| 7,246,667 | B2 | 7/2007 | Cook et al. | |
| 7,255,176 | B2 | 8/2007 | Adam et al. | |
| 7,258,168 | B2 | 8/2007 | Cook et al. | |
| 7,270,188 | B2 | 9/2007 | Cook et al. | |
| 7,290,616 | B2 | 11/2007 | Cook et al. | |
| 7,299,881 | B2 | 11/2007 | Cook et al. | |
| 7,308,755 | B2 | 12/2007 | Cook et al. | |
| 7,325,602 | B2 | 2/2008 | Cook et al. | |
| 7,350,564 | B2 | 4/2008 | Cook et al. | |
| 7,357,188 | B1 | 4/2008 | Cook et al. | |
| 7,357,190 | B2 | 4/2008 | Cook et al. | |
| 7,363,691 | B2 | 4/2008 | Cook et al. | |
| 7,370,699 | B2 | 5/2008 | Adam et al. | |
| 7,380,604 | B2 | 6/2008 | Adam et al. | |
| 7,086,475 | B2 | 8/2008 | Cook | |
| 7,410,000 | B2 | 8/2008 | Cook et al. | |
| 7,416,027 | B2 | 8/2008 | Ring et al. | |
| 7,419,009 | B2 | 9/2008 | Cook et al. | |
| 7,434,618 | B2 | 10/2008 | Cook et al. | |
| 7,438,132 | B2 | 10/2008 | Cook et al. | |
| 7,458,422 | B2 | 12/2008 | Adam et al. | |
| 7,516,790 | B2 | 4/2009 | Cook et al. | |
| 7,546,881 | B2 | 6/2009 | Lloyd et al. | |
| 7,552,772 | B2 | 6/2009 | Carmody et al. | |
| 7,556,092 | B2 | 7/2009 | Cook et al. | |
| 7,603,758 | B2 | 10/2009 | Cook et al. | |
| 7,665,532 | B2 | 2/2010 | Cook et al. | |
| 7,708,060 | B2 | 5/2010 | Adam et al. | |
| 7,730,955 | B2 | 6/2010 | Farquhar et al. | |
| 7,740,076 | B2 | 6/2010 | Costa et al. | |
| 8,225,878 | B2 * | 7/2012 | Adam et al. | 166/384 |
| 2008/0156499 | A1 | 7/2008 | Giroux et al. | |
| 2009/0266560 | A1 | 10/2009 | Ring et al. | |
| 2010/0206587 | A1 * | 8/2010 | Adam et al. | 166/386 |

* cited by examiner

PUMP DOWN SWAGE EXPANSION METHOD

FIELD OF THE INVENTION

The field of the invention is a method of expansion of tubulars downhole and more particularly expanding one tubular into contact with an existing tubular where the added tubular is expanded into a supporting position by advancing a swage through the new tubular by moving it downhole using pressure from the surface.

BACKGROUND OF THE INVENTION

Monobore applications using expansion have integrated cementing through a shoe while covering a recess at the end of an existing string with a removable cover that comes off after cementing. A string with a swage is placed in position and the swage is energized to grow in diameter before being advanced through the newly added tubular until the swage exits the top of the added tubular to fixate it into the recess at the lower end of the existing tubular. The result is a monobore well. These designs have also disclosed a deployable shoe that can be delivered with the string prior to expansion and then tagged and retained as a swage moves through the string only to be reintroduced into the expanded string and sealingly fixated to it for the cementing operation. Examples of one or more of these method steps are illustrated in U.S. Pat. Nos. 7,730,955; 7,708,060; 7,552,772; 7,458,422; 7,380,604; 7,370,699; 7,255,176 and 7,240,731. Other patents relating to expansion by moving a cone uphole from within a bell at a lower end of a liner to be supported to a recess in existing tubing and creating a monobore as well as expansion of tubulars downhole are as follows:

| | | | | |
|---|---|---|---|---|
| 6,712,154; | 7,185,710; | 7,410,000; | 7,350,564; | 7,100,684; |
| 7,195,064; | 7,258,168; | 7,416,027; | 7,290,616; | 7,121,352; |
| 7,234,531; | 7,740,076; | 7,100,685; | 7,556,092; | 7,516,790; |
| 7,546,881; | 6,328,113; | 7,086,475; | 6,745,845; | 6,575,240; |
| 6,725,919; | 6,758,278; | 6,739,392; | 7,201,223; | 7,204,007; |
| 7,172,019; | 7,325,602; | 7,363,691; | 7,146,702; | 7,172,024; |
| 7,308,755; | 6,568,471; | 6,966,370; | 7,419,009; | 7,040,396; |
| 6,684,947; | 6,631,769; | 6,631,759; | 7,063,142; | 6,705,395; |
| 7,044,221; | 6,857,473; | 7,077,213; | 7,036,582; | 7,603,758; |
| 7,108,061; | 6,631,760; | 6,561,227; | 7,159,665; | 7,021,390; |
| 6,892,819; | 7,246,667; | 7,174,964; | 6,823,937; | 7,147,053; |
| 7,299,881; | 7,231,985; | 7,168,499; | 7,270,188; | 7,357,190; |
| 7,044,218; | 7,357,188; | 7,665,532; | 7,121,337; | 7,434,618; |
| 7,240,729; | 7,077,211; | 7,195,061; | 7,198,100; | 6,640,903; |
| 7,438,132; | 7,055,608; | 7,240,728; | 7,216,701; | 6,604,763; |
| 6,968,618; | 7,172,021; | 7,048,067; | 6,976,541; | 7,159,667; |
| 7,108,072 and | 6,557,640. | | | |

Particularly noteworthy with regard to the present invention is U.S. Pat. No. 7,121,351, which uses a seal to drive a swage up from below to expand a tubular.

Methods that mechanically advance a swage through a tubular require the rig equipment to not only support the weight of the string to be expanded but also to be able to handle the applied force to the swage to advance it through the tubular to enlarge the diameter. The present invention reduces the surface equipment capacities needed to perform an expansion to create, for example, a monobore. The method features a top down expansion using a plurality of adjustable swages that get built at different times and that are driven from applied annulus pressure delivered around a workstring. The tubular to be expanded is placed in an overlapping position with an existing tubular. The swage assembly is pushed on a guide extending from the running string by virtue of a cup seal around the running string and another peripheral seal on the top of the liner to be expanded to prevent pressure bypassing as the swage assembly is run into the liner string to support the liner without sealing it. A further swage is built to a larger diameter than the first expansion in the liner at a location below the support point to the existing liner and the balance of the liner is expanded to bottom while engaging the cement shoe as the swage assembly leaves the lower end of the now expanded liner. The shoe is repositioned and set at the lower end of the expanded liner and a cement job follows with a subsequent circulating out of excess cement. The swage assembly is pulled through the liner and another swage is built before it is pushed down through the liner top to set the seal of the liner hanger or optionally to go though past the slips of the liner hanger to create a constant drift though the expanded liner top. The assembly is removed to create a monobore with a recessed liner shoe for a future monobore installation.

The method of the present invention uses running string and liner peripheral seals to move a swage assembly for gaining liner support. It continues in that mode with building another swage after support of the liner in the existing tubular. In the same trip the shoe is secured and the liner cemented followed by engaging the seal of the liner hanger with manipulation of the running string. These features along with others that are explained in detail in the discussion of the preferred embodiment and the associated drawings will become more apparent to those skilled in the art from a review of those sections, while recognizing that the full scope of the invention is to be found in the appended claims.

SUMMARY OF THE INVENTION

The tubular string to be expanded is run in on a running string. The swage assembly has a seal from the running string to the existing tubular and the top of the tubular string to be expanded also has a seal against the exiting tubular. Annulus pressure around the running string drives the swage assembly to support the expanded tubular to the exiting tubular and to continue expansion to the end of the tubular. Cementing then takes place followed by reconfiguring the swage assembly to engage the liner hanger seal with the result being a monobore connection with recessed shoe in a single trip including the cementing.

DETAILED DESCRIPTION OF THE PREFERRED EMBODIMENT

Figure 1:
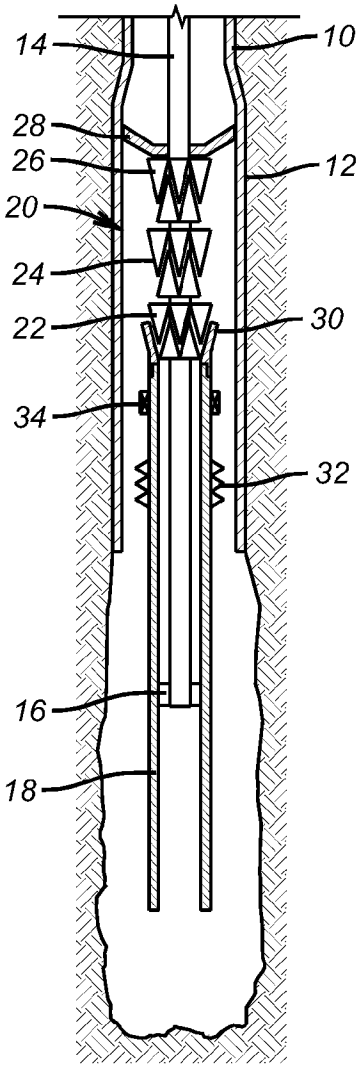
FIG. 1 shows the liner supported by the running string in the desired location at the lower end of the existing tubular.

FIGS. 1-7 illustrate the method in general terms and will be used as an introduction before discussing the specifics in greater detail. An existing tubular 10 has a bottom bell 12. As an option there can be an open hole where at least portions thereof have no existing tubular 10. A running string 14 has a lower end 16 that initially and releasably supports the tubular string or liner 18. A swage assembly 20 has three segmented swage rings 22, 24 and 26. While three adjustable swages are preferred, the various expansions can be done with at least one swage that is adjustable to differing expansions diameters to perform the various method steps at the time those method steps need to occur and providing the targeted degree of expansion at each step. A swage assembly seal 28 is mounted to the running string 14 for tandem movement and extends radially for initial sealing contact with the bell 12. The liner 18 has a top seal 30 that is allowed to engage the bell 12 when the expansion starts to engage the slips 32 to the bell 12. A seal 34 is set against the bell 12 by expansion after cementing takes place. The lower end 16 acts as a travel stop for the swage assembly 20. The swage assembly 20 and the seal 28 can move relatively to the running string 14. The running string 14 is preferably anchored to the existing tubular 10 when pressure against seal 28 drives the swage assembly 20 relative to the running string 14 until the travel stop at the lower end 16 is reached.

Figure 2:
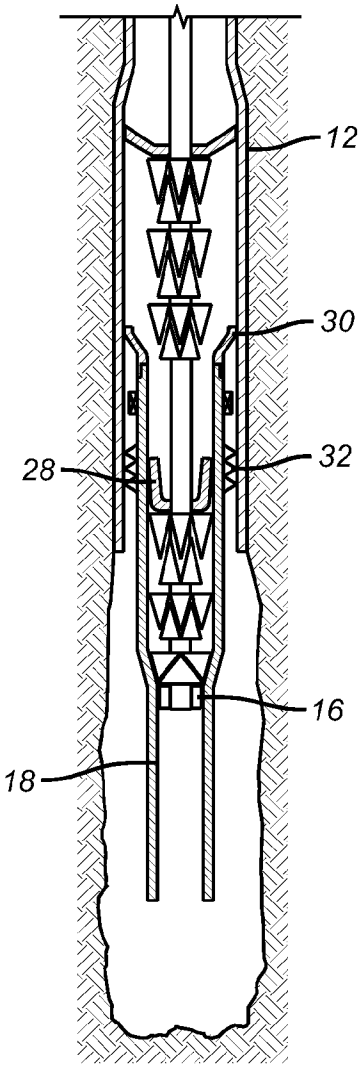
FIG. 2 is the view of FIG. 1 showing the advancing swage assembly supporting the liner to the surrounding tubular.

FIG. 2 shows annulus pressure around the running string 14 and against the seal 28 driving the swage assembly 20 along the running string 14 that is now anchored to the existing tubular 10. Note that the seal 30 at the top of the liner 18 is against the bell 12 so that the seal 28 can still be driven into the liner 18 to the point where the travel stop at the lower end 16 is engaged and the slips 32 being set to support the liner 18 to the bell 12.

Figure 3:
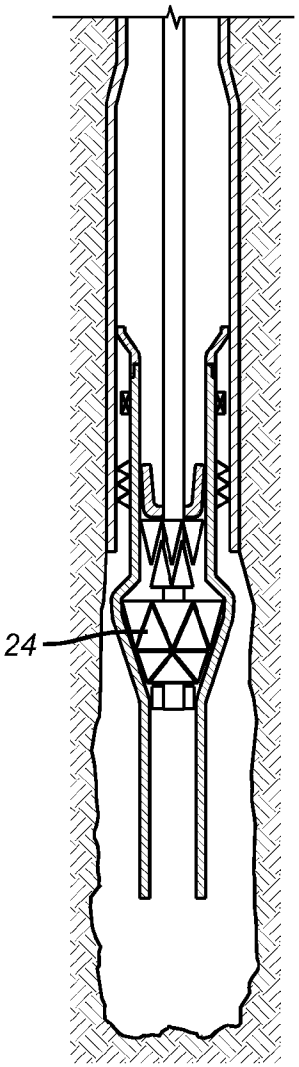
FIG. 3 is the view of FIG. 2 showing the swage assembly having passed the lower end of the existing tubular and being built to finish the expansion.
Figure 4:
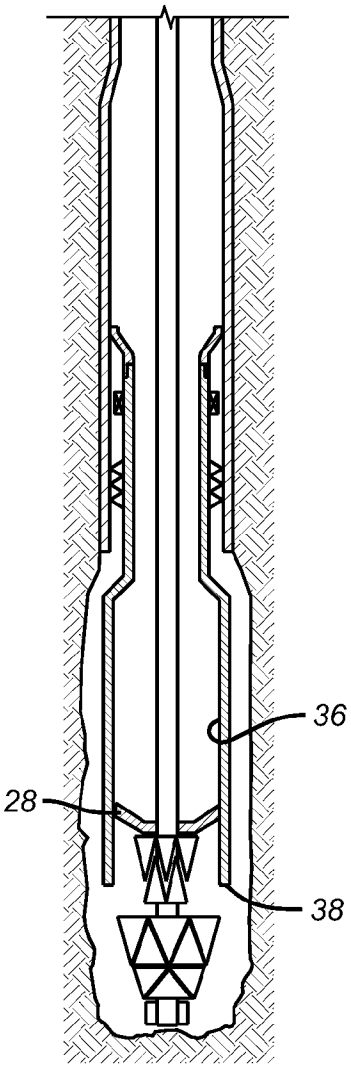
FIG. 4 is the view of FIG. 3 showing the swage assembly out the lower end of the expanded tubular and ready to locate and set a cementing shoe at the lower end to facilitate the cementing step.
Figure 7:
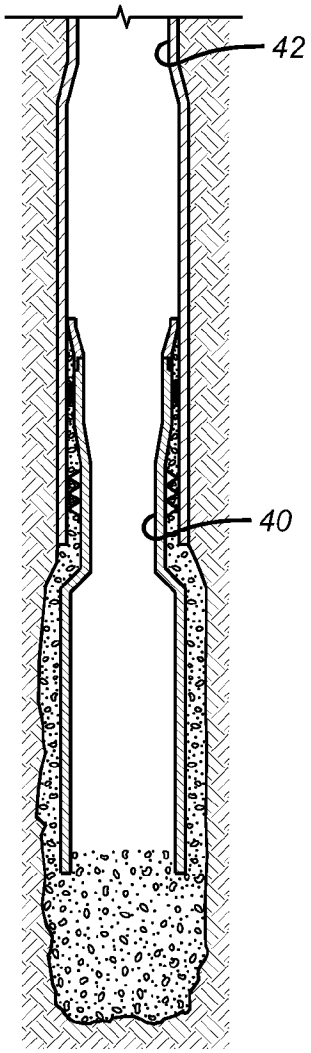
FIG. 7 is the view of FIG. 6 with the running string removed.

In FIG. 3, the swage 24 is built in place and the pressure against seal 28 continues so that the swage assembly 20 is driven out the lower end of the liner 18 as shown in FIG. 4. A bell 36 is now created in the lower end of the liner 18. While the expansion reached the lower end 38, a cement shoe that is not shown was grabbed and put out beyond the end 38 and then brought back after the swage assembly 20 was pushed past the lower end 38. When the cement shoe is brought back into the bell 36 it is secured and sealed to the bell 36 and the connection is pressure tested before the cement delivery begins as shown in FIG. 5.

Figure 6:
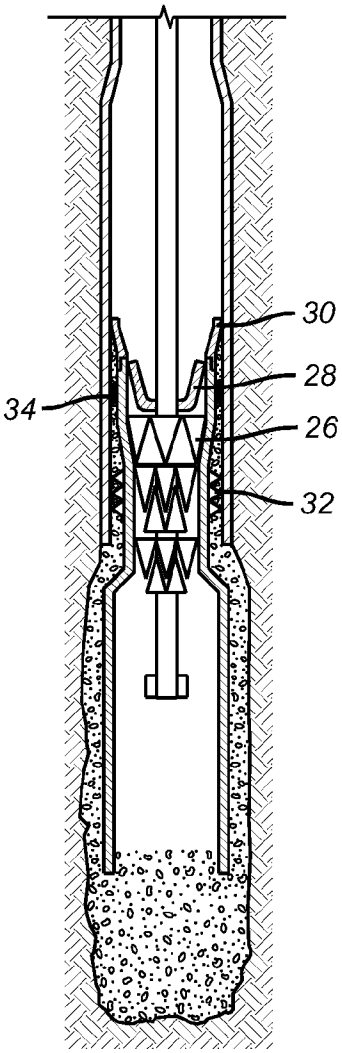
FIG. 6 shows the swage assembly brought down from the FIG. 5 position to set the liner hanger seal.
Figure 5:
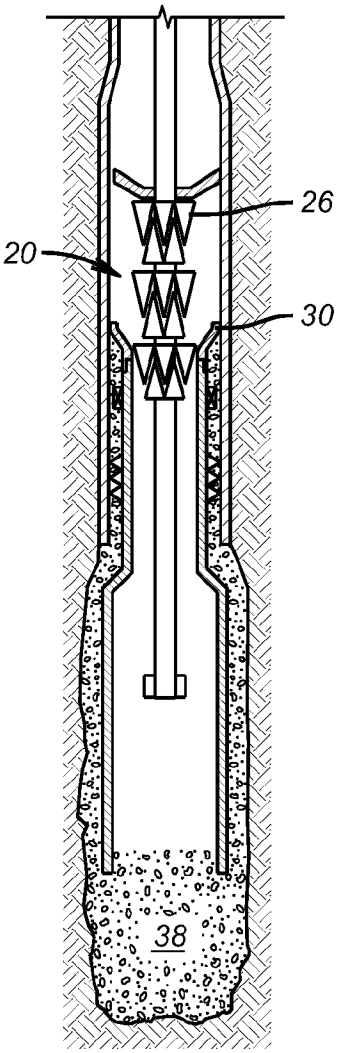
FIG. 5 is the view of FIG. 4 after cementing is done and the swage assembly is raised out of the liner and built again to set the liner hanger seal.

FIG. 5 shows the cement 38 delivered and the running string 14 picked up to put the swage assembly 20 above the seal 30 so that swage 26 can be built for subsequent setting of the seal 34 against the bell 12 as shown in FIG. 6. After setting the seal 34 against the bell 12 the running string 14 and everything that it supports is removed leaving a cemented monobore connection where the diameter at 40 is the same as the diameter at 42 and a bell 36 is formed the same as the diameter at 12. Optionally in FIG. 6 the swage 26 can be pushed with pressure past the slips 32 to insure the same dimension 40 at both the slips 32 and the adjacent hanger seal 34.

Figure 8:
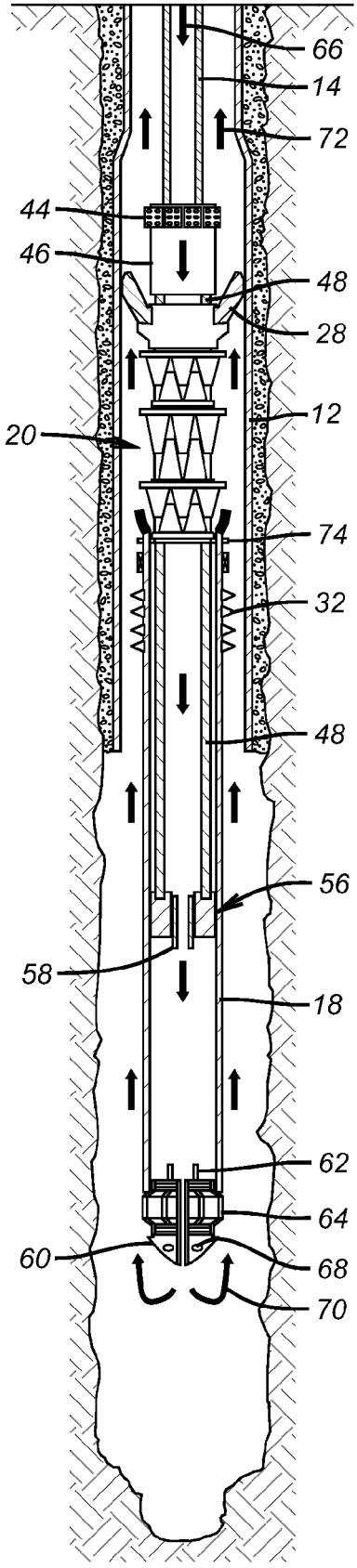
FIG. 8 is a more detailed view of the assembly shown as it is being run in with the liner to be expanded.
Figure 26:
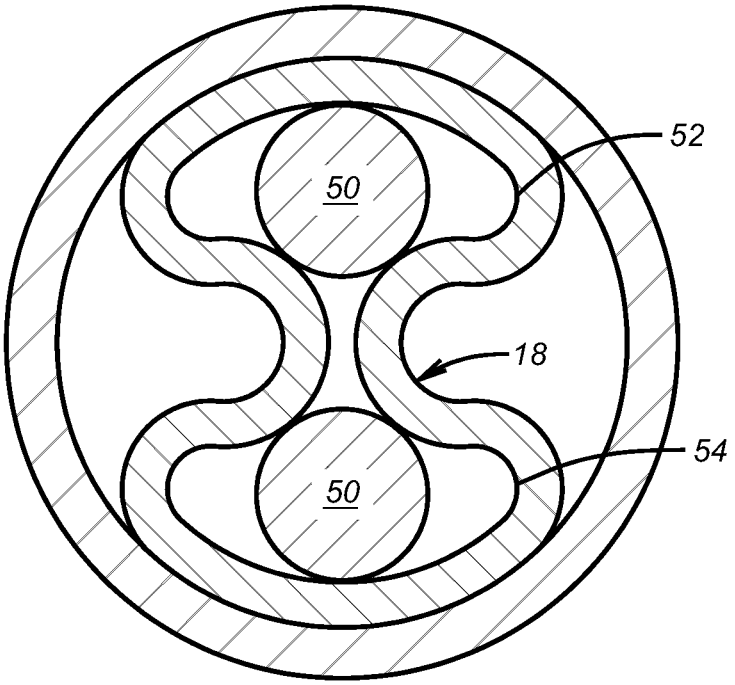
FIG. 26 shows a section through a folded version of the liner to be expanded showing the running tool location in the form of parallel guides for the expansion.

FIG. 8 shows the assembly of FIGS. 1-6 in greater detail. An anchor 44 is attached to the running string 14 and shown in the unset position to allow running in with the running string 14. There is a hub 46 that supports the anchor 44 and the mandrel 48. Note that if the tubular 18 is a rounded shape then the mandrel 48 is preferably a tubular rounded shape as well. On the other hand as shown in FIG. 26 if the liner string 18 is folded for example in the manner shown then the mandrel 48 can be a pair of parallel rods 50 disposed in the folds 52 and 54. A running tool 56 serves an initial purpose of grip of the liner 18 to the bell 12 until the slips 32 are expanded into the bell 12. Tool 56 also has a grip assembly 58 that can selectively engage a receptacle 62 in the cement shoe 60 for engaging the grip and seal assembly 64 to the bell 12 as will be explained below. Circulation when running in is represented by arrow 66 showing flow through the running string 14 and through the hub 46 and the mandrel 48 leading out through openings 68 in the shoe 60 as represented by arrows 70. Returns are represented by arrow 72 showing flow uphole past the seal 28. A breakable connection 74 temporarily connects the swage assembly 20 to the liner 18.

Figure 8A:
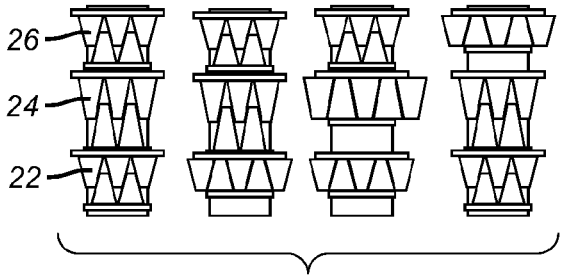
FIG. 8*a* shows the swage assembly in its various operating modes.

FIG. 8*a* shows the various positions of the swage assembly 20 with the first view showing all three swage segment rings 22, 24 and 26 in the unbuilt position for run in, followed by building ring 22 for setting the slips 32, followed by building the swage 24 for expanding the bell 36 for the balance of the downhole directed expansion followed by relaxing swages 22 and 24 and building swage 26 to expand the hanger seal 34 into the bell 12. After that the swage 26 is collapsed and the swage assembly 20 and the mandrel 28 are pulled out with the running string 14.

Figure 9:
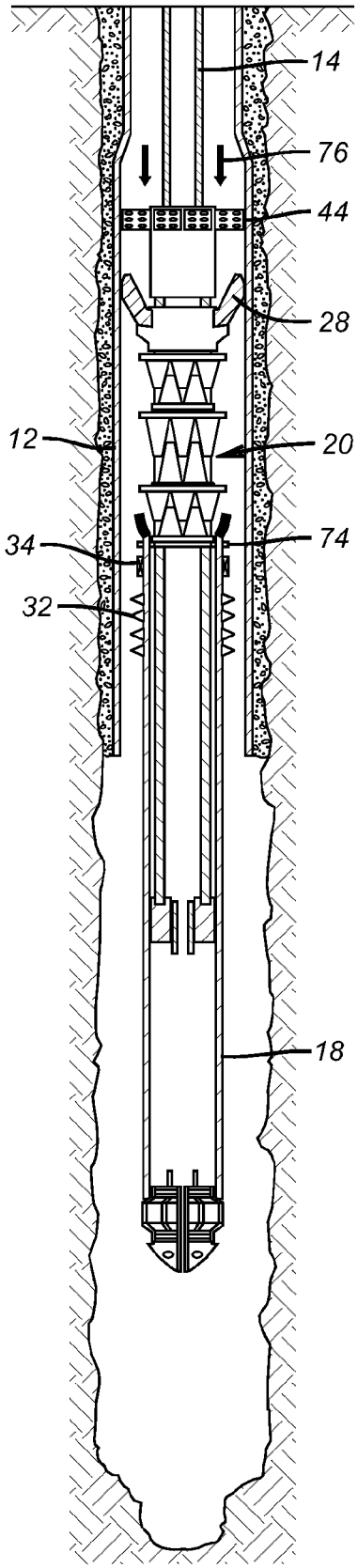
FIG. 9 is the view of FIG. 8 with the anchor set to the existing tubular.

In FIG. 9 pressure applied in the annulus as represented by arrow 76 against the seal 28 sets the anchor 44 as the seal 28 holds pressure against the bell 12. Doing this isolates the string 14 above the anchor 44 from tensile stress from driving the swage assembly 20 along the mandrel 48 to set the slips 32. The slips 32 and the seal 34 are positioned within the bell 12 so that they can ultimately be used to support the liner 18. All the swages in the assembly 20 are collapsed to their smallest dimension at this time. Connection of the swage assembly 20 to the liner 18 at 74 is still intact.

Figure 10:
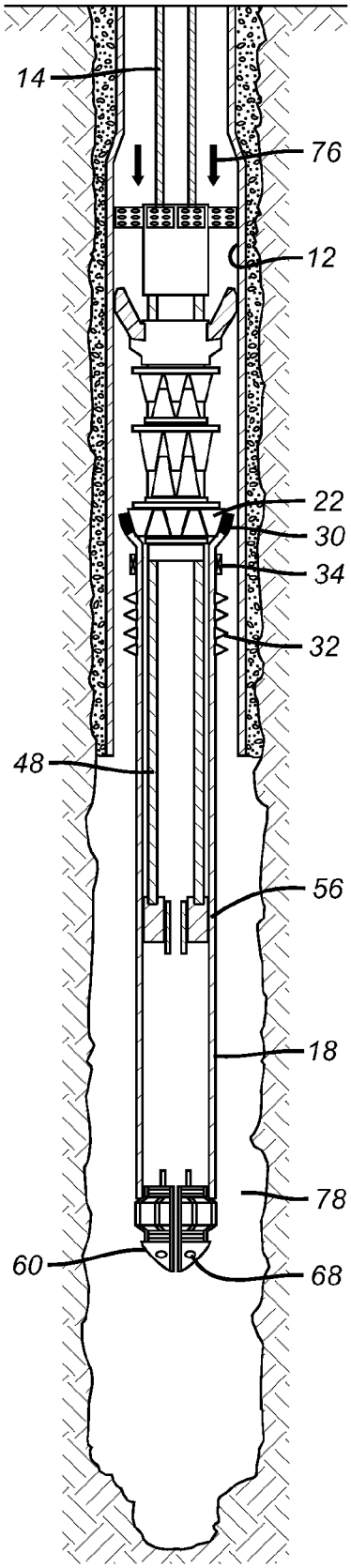
FIG. 10 shows the swage assembly sheared from the liner top while the liner is still retained by the running string at a lower location.

In FIG. 10 the connection 74 is sheared leaving the liner 18 still supported at running tool 56. Swage ring 22 is now built and is pushed with pressure against seal 28 represented by arrows 76 so that seal 30 is pushed out radially to the bell 12. The pressure 76 goes through the open anchor 44. Expansion of the liner 18 has yet to start. Displaced fluid from the expansion and the seal 28 movement, once it starts will go down annulus 78 and through openings 68 in the cement shoe 60 and up through the mandrel 48 and into the running string 14 for the trip to the surface.

Figure 11:
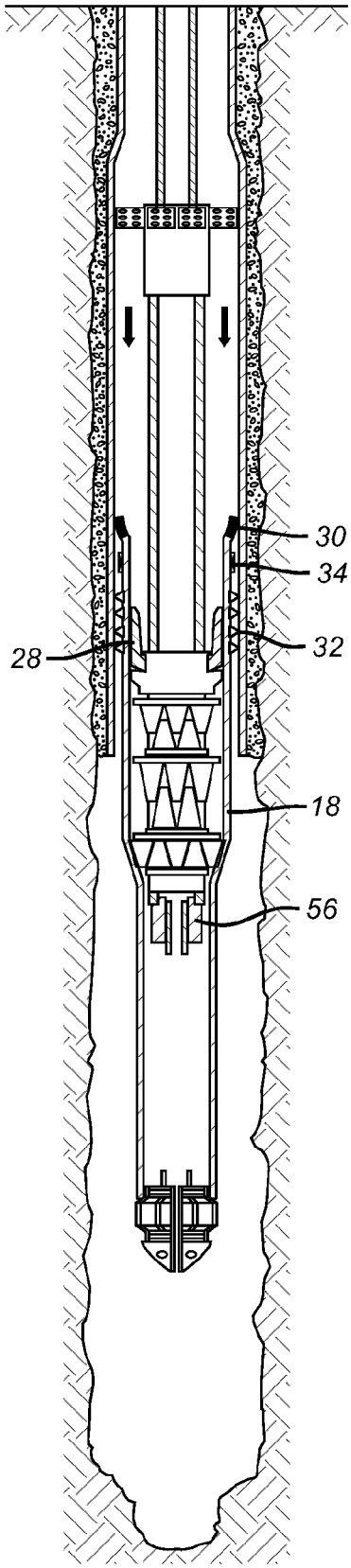
FIG. 11 shows the swage assembly driven to support the liner to the existing tubular; and the swage assembly bottoming on the running tool to release the liner.

FIG. 11 shows the slips 32 set and the seal 34 not yet set. The seal 28 is flexible and has gone into the liner 18. The seal 30 on the top of the liner 18 is in contact with the bell 12 so that pressure that is applied to seal 28 to drive it and the swage assembly 20 in tandem will not be lost around the outside of the liner 18. As the swage assembly 20 travels along mandrel 48 it reaches the running tool 56 which is now disengaged from the liner 18 as that connection has been released because the slips 32 are now supporting the liner 18.

Figure 12:
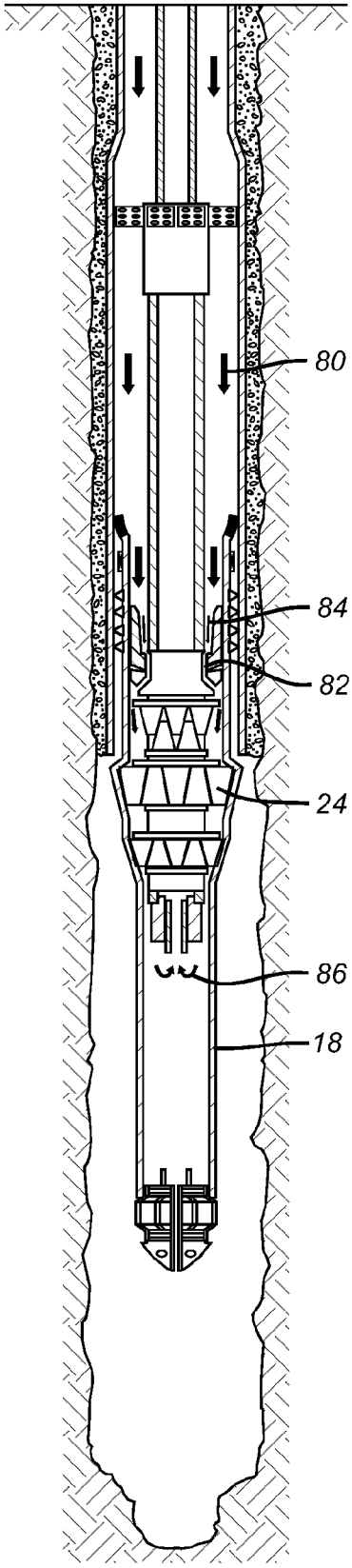
FIG. 12 shows the second swage fully built and bypass on the cup seal on the swage assembly being opened.

FIG. 12 shows continuing application of pressure represented by arrows 80 as the swage assembly is bottomed on the running tool 56. Such bottoming allows the wedge segment swage 24 to build in place by pushing out the wall of the liner 18 followed by opening a bypass 82 in the seal 28. Return flow represented by arrow 86 goes back to the surface through the running string 14. An optional hydraulic stroker tool (not shown) can be employed in the effort to build the swage ring 24 in place before expansion resumes.

Figure 13:
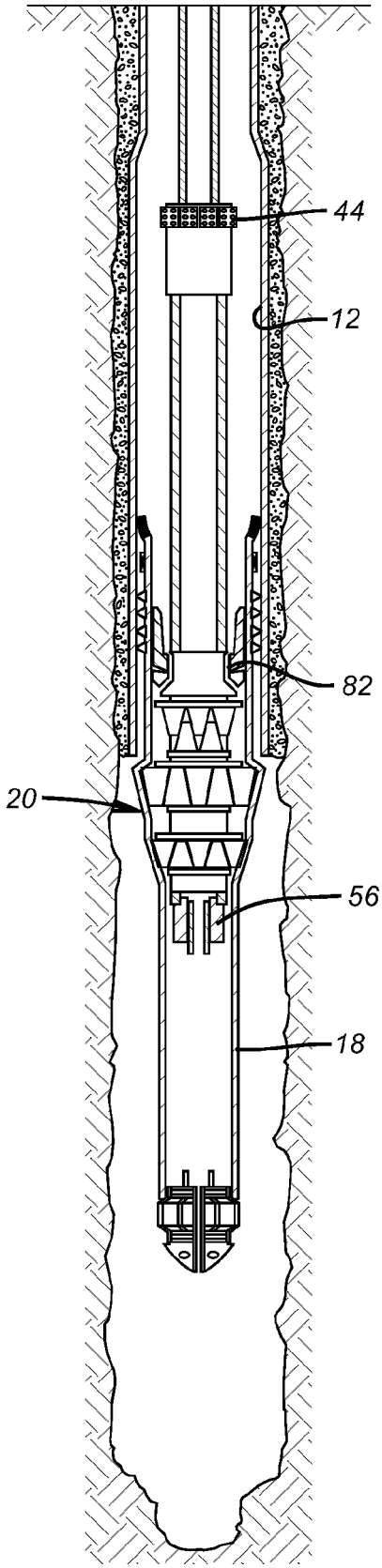
FIG. 13 shows the anchor on the running string released from the existing tubular.
Figure 14:
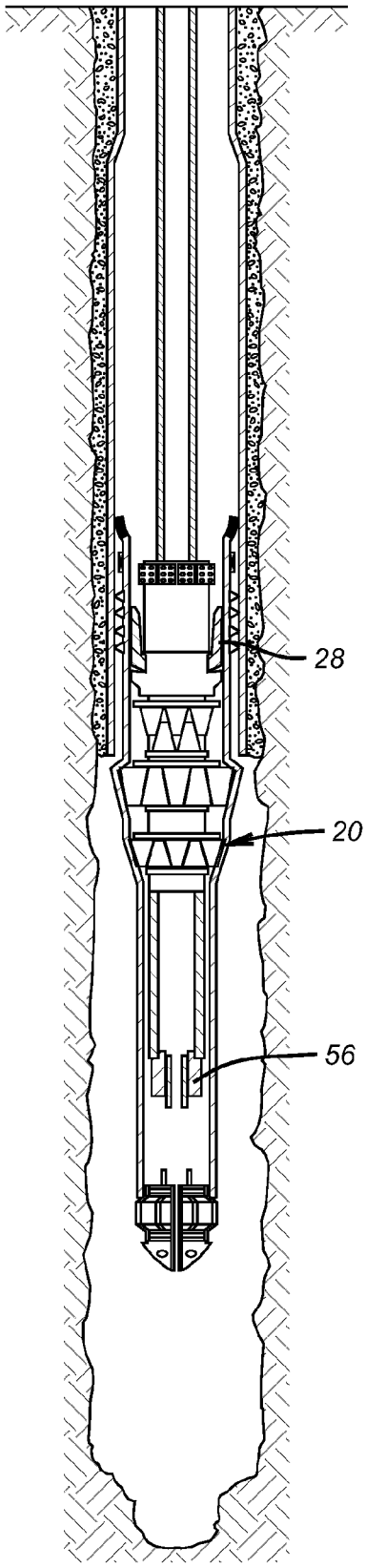
FIG. 14 shows the bypass closed on the swage assembly seal and the running string repositioned for completing the expansion to the lower end of the liner.

FIG. 13 shows the anchor 44 no longer contacting the bell 12 so that pressure application onto the seal 28 will now drive the swage 26 and running string 14 together to further expand the liner 18. Note that before the expansion can start the bypass 82 needs to be closed by setting down weight to get the swage assembly 20 out of the running tool 56. This is because when the swage assembly 20 bottoms on the running tool 56, the bypass 82 on the seal 28 opens automatically. FIG. 14 shows such slacking off to put the running tool 56 away from the swage assembly 20. The cup seal 28 is shown schematically without the bypass 82 indicating that such bypass is closed.

Figure 15:
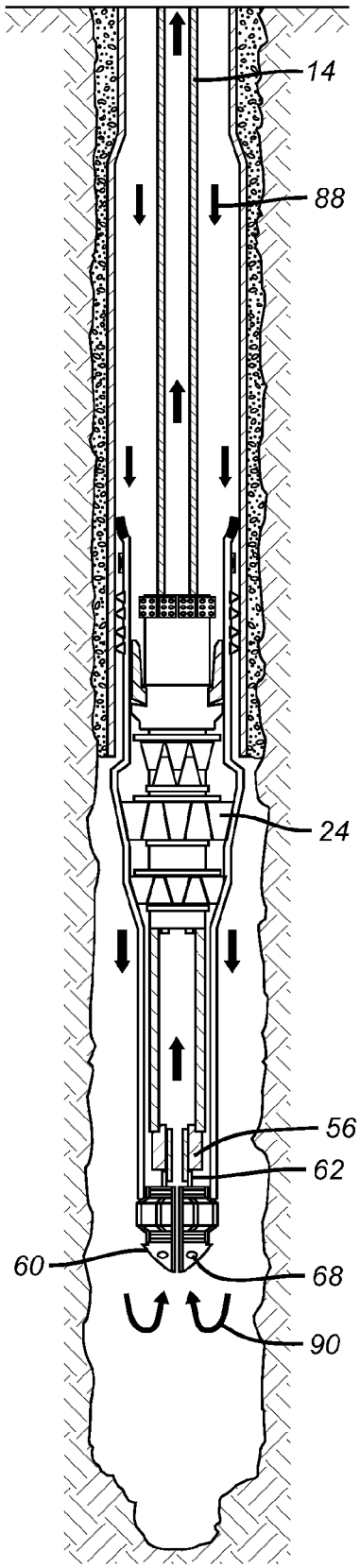
FIG. 15 shows the cement shoe engaged before the balance of expansion begins.

FIG. 15 shows application of annulus pressure represented by arrows 88 and the start of the movement of swage 24 in the built condition along with swage 22 that is below it and is still in the built condition. Fluid displacement from expansion is represented by arrows 90 and is directed to the surface through the running string 14. Note that the running tool 56 has been stabbed into the receptacle 62 so that the cement shoe 60 is engaged. This stabbing holds open the openings 68 on the shoe 60.

Figure 16:
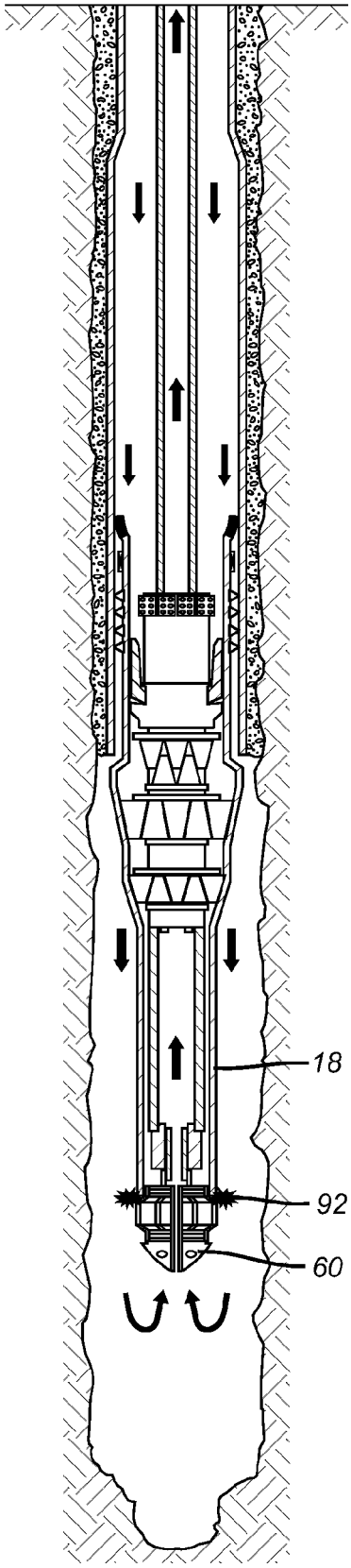
FIG. 16 shows grabbing the cement shoe to remove it from the liner bottom as the swage assembly approaches the liner bottom.
Figure 17:
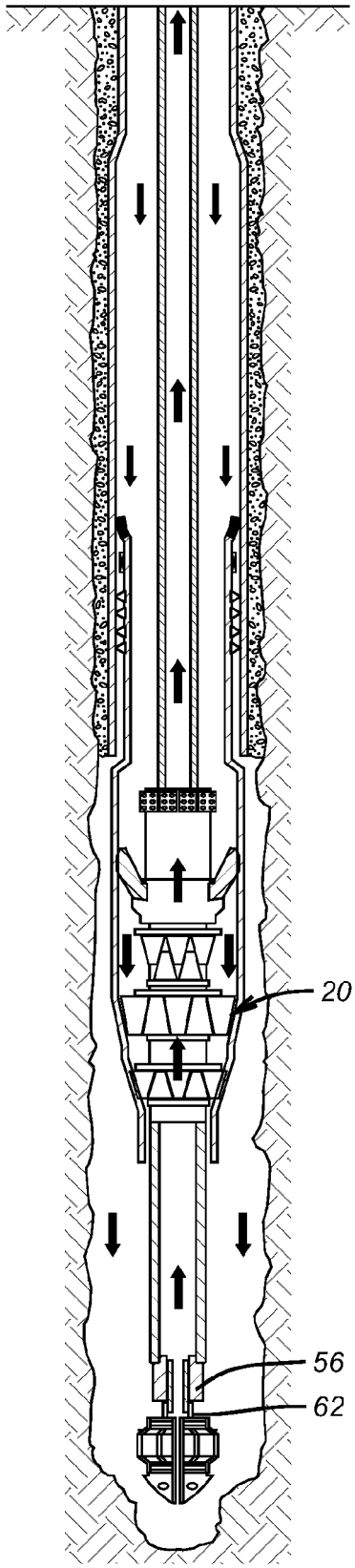
FIG. 17 shows the shoe out of the liner bottom as the swage assembly approached the liner bottom.
Figure 18:
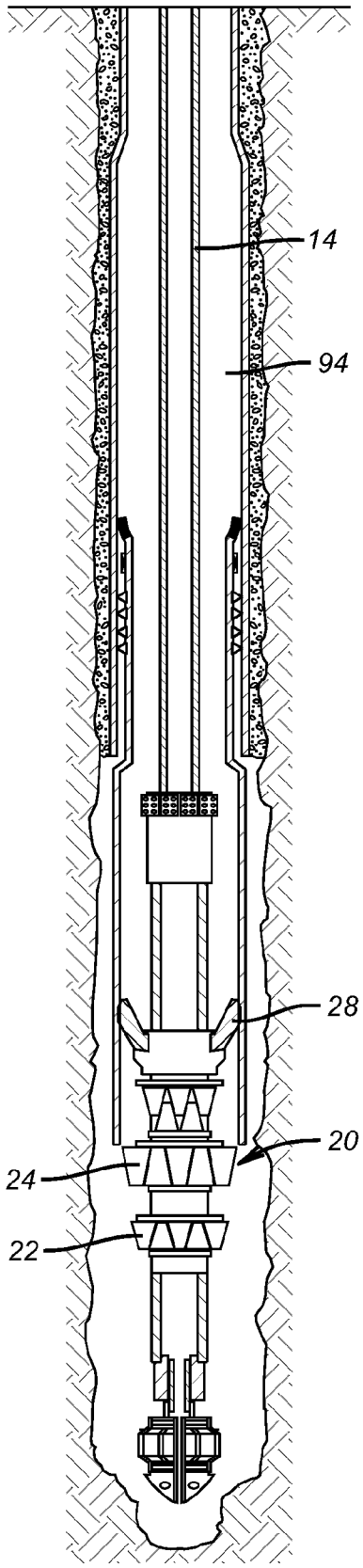
FIG. 18 shows the swage assembly out of the liner bottom.
Figure 19:
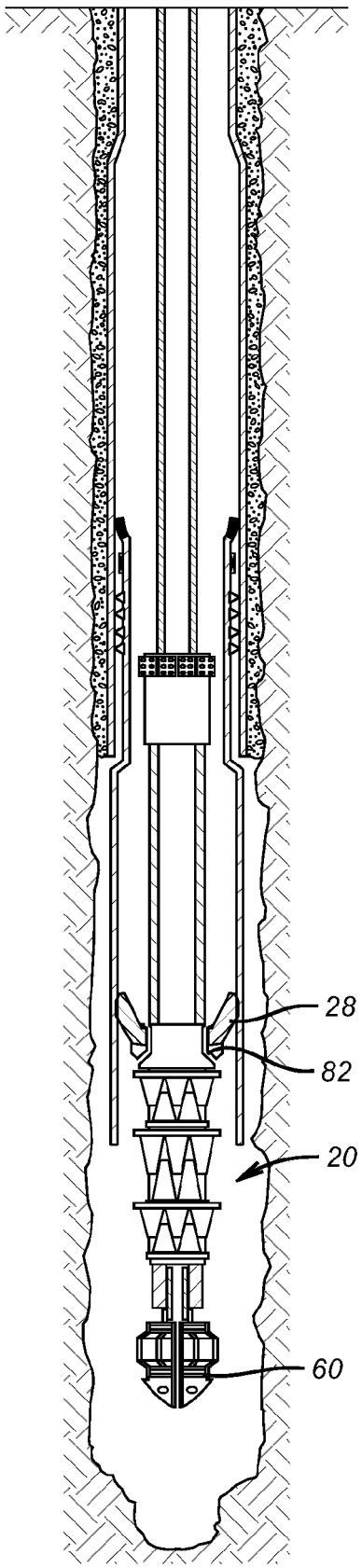
FIG. 19 shows a pickup force to bring the running string up against the swage assembly to open the bypass on the swage assembly seal.

In FIG. 16 the cement shoe 60 is detached from the liner 18 so that the swage assembly can pass out of the liner 18 while retaining the cement shoe 60. This can be done with pressure and breaking a shear pin shown schematically as 92 or some type of latching dog arrangement can be used to grip the shoe 60 and carry it out through the bottom of the liner 18. In FIG. 17 the swage assembly 20 is approaching the lower end of the liner 18 while the shoe 60 is further extended from liner 18 by engagement with the running tool 56 at receptacle 62. Application of set down weight as this is happening prevents the bypass 82 (not shown in this view) from opening in seal 28 so that applied pressure can keep the swage assembly 20 moving toward the lower end of the liner 18. FIG. 18 shows the swages 22 and 24 exiting the lower end of the liner 18. The expansion of the liner 18 is completed to the lower end and the next thing to happen is preparation for cementing. The swage assembly 20 is allowed to collapse as it exits the liner 18. A pickup force on the string 14 brings up the running tool 56 against the swage assembly 20 which opens the bypass 82 on the seal 28 as shown in FIG. 19.

Figure 20:
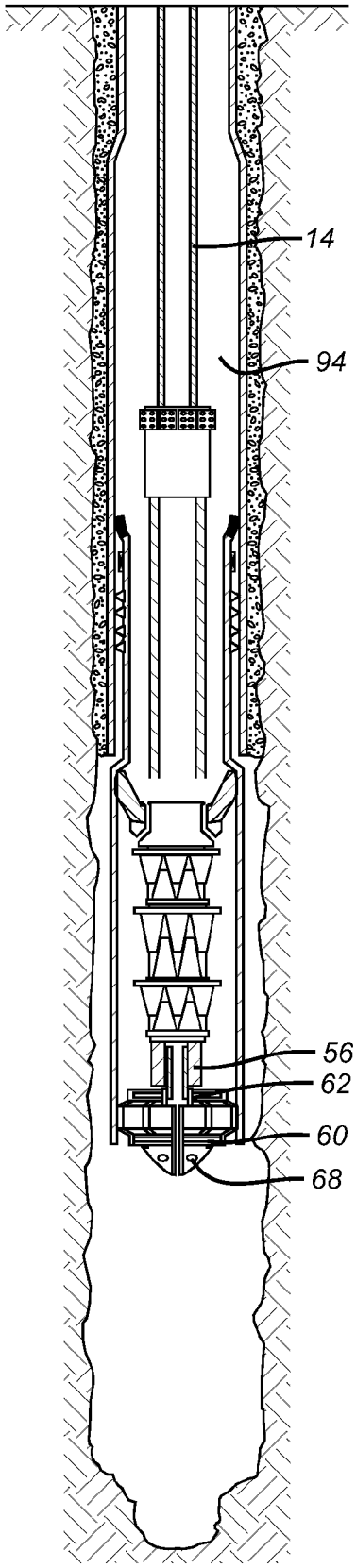
FIG. 20 shows the cement shoe back in the liner and sealingly secured to the liner for cementing.

What follows is picking up the cement shoe 60 into the liner 18 and setting its seal and grip assembly 64 as shown in FIG. 20. After that is done the string 14 is picked up to remove the running tool 56 from the receptacle 62 and to apply pressure into running string 14 and the annulus 94 with the bypass 82 still open since the swage assembly is sitting on the running tool 56 so that the integrity of the seal and grip assembly 64 can be tested. Having passed the pressure test for the cement shoe, the running tool 56 is lowered back into the receptacle 62 so that the cementing can begin through the shoe 60 and its openings 68.

Figure 21:
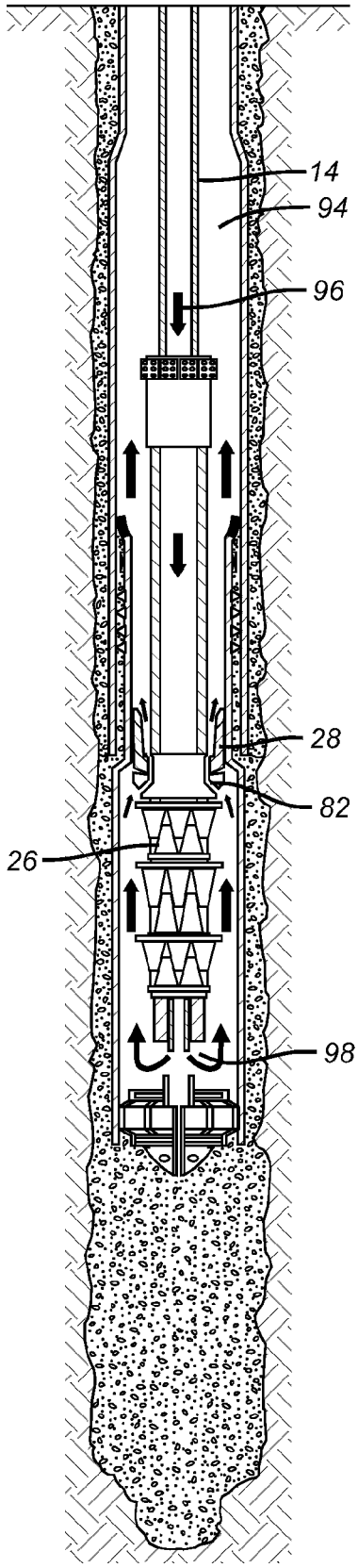
FIG. 21 shows circulating out excess cement after the cementing job.
Figure 22:
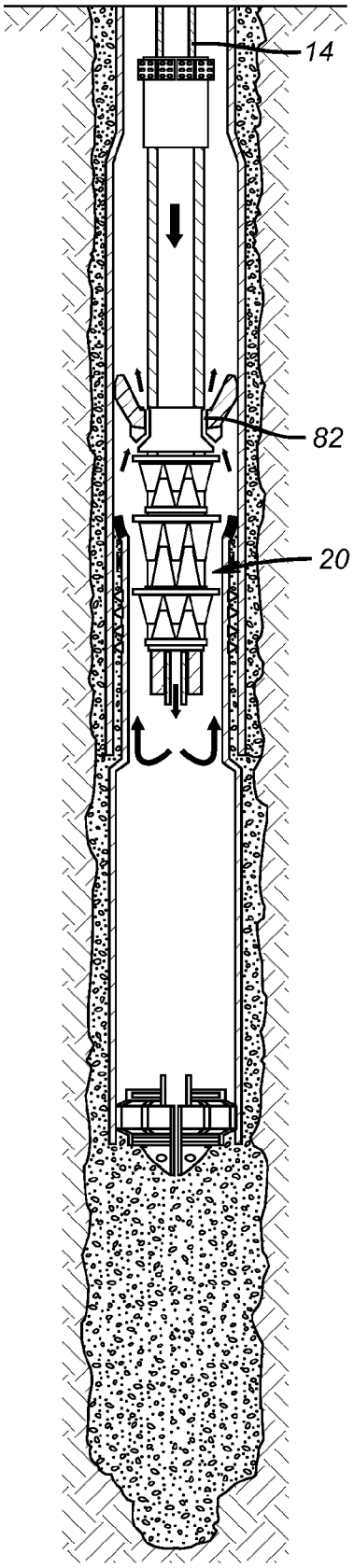
FIG. 22 shows picking up the work string to open the swage assembly bypass and then building another swage in the assembly with flow to set the seal for the liner hanger.

After the cementing is complete, the running tool 56 is picked up from the receptacle 62 as shown in FIG. 21 and fluid is circulated down the running string 14 as represented by arrows 96 and out through the running tool 56 as represented by arrows 98 and through the bypass 82 in seal 28. The excess cement goes to the surface through annulus 94. Thereafter the work string 14 is picked up and fluid is pumped down the annulus 94 with the bypass 82 still open or alternatively pressure can be pumped down the string 14 to move the seal 28 up with respect to the liner 18. This movement is continued until the swage 26 is above the upper end of the liner 18. At this point as shown in FIG. 22 the flow rate is increased with the bypass 82 still held open because the swage assembly 20 is against the running tool 56. This helps to move the cup seal 28 out of the liner 18 with a result that the bypass 82 will close.

Figure 23:
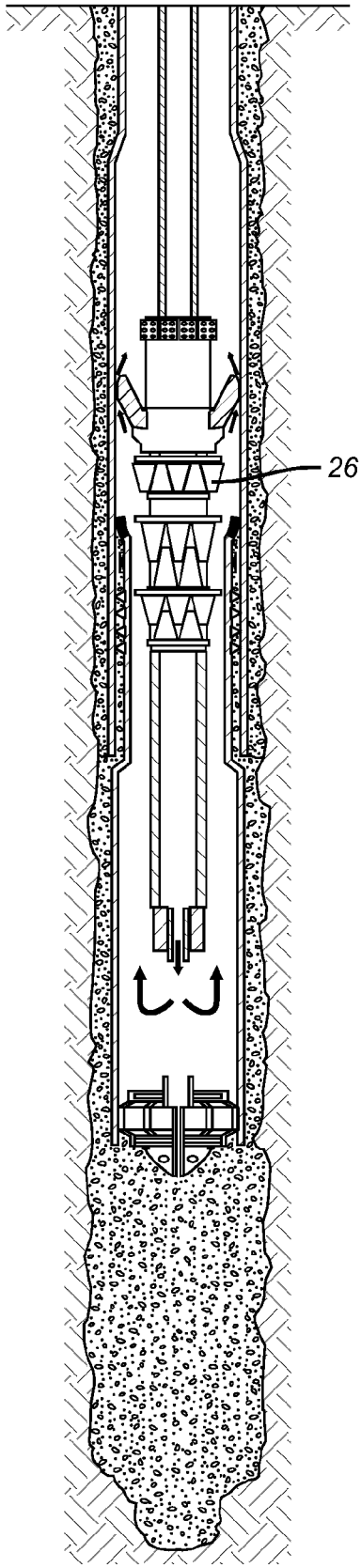
FIG. 23 shows the largest swage built with circulation.
Figure 24:
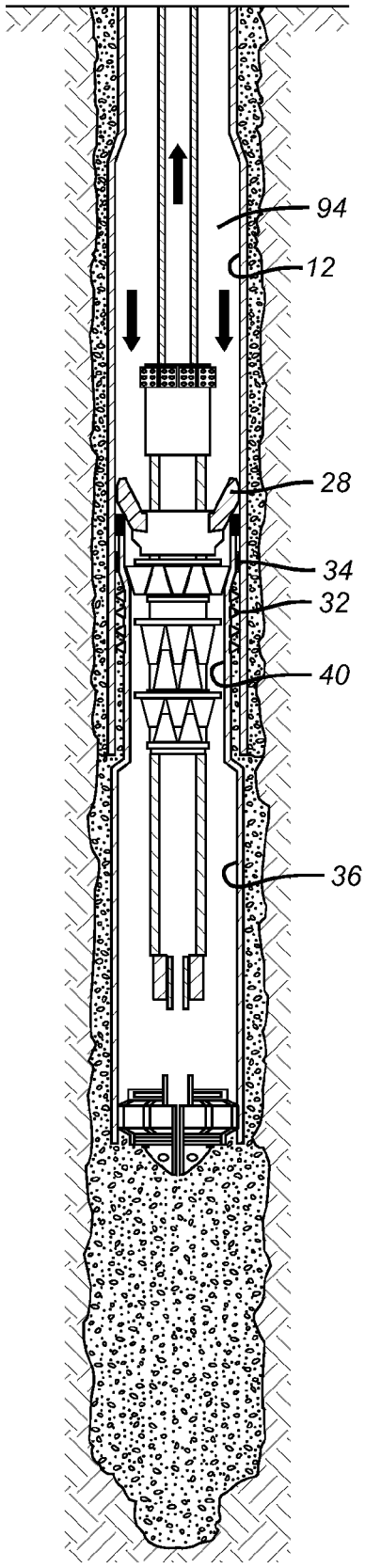
FIG. 24 shows expanding the liner hanger seal into the surrounding tubular.
Figure 25:
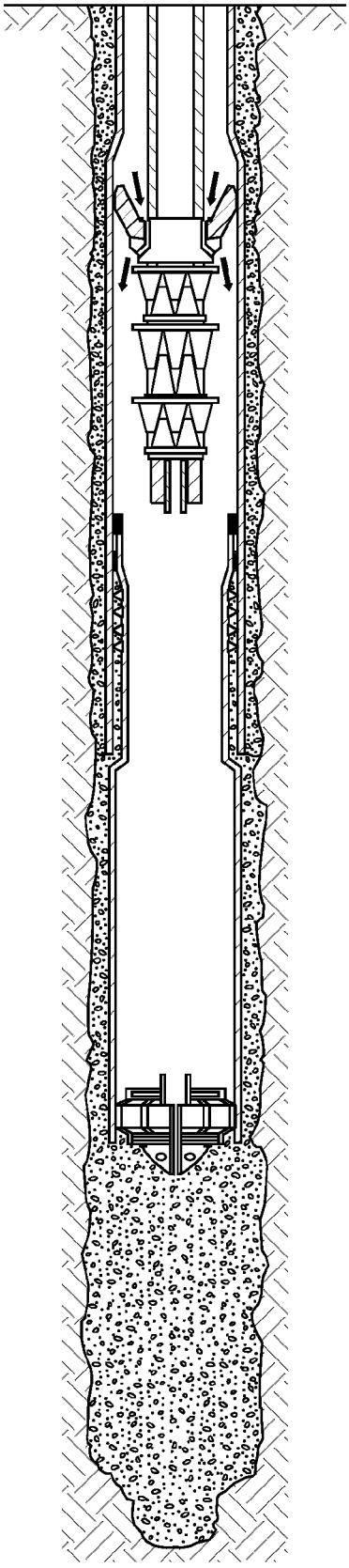
FIG. 25 shows collapsing the swage assembly and pulling out of the hole with the swage assembly seal in the open position.

As shown in FIG. 23 the swage assembly 20 has moved due to flow to the anchor 44 and the swage ring 26 now builds to its maximum dimension in preparation for setting the liner seal 34. The string 14 is then set down to get the swage 26 at the top of the liner 18 for the expansion of the seal 34. As shown in FIG. 24, the pressure is then applied in the annulus 94 against seal 28. This drives the swage 26 into the liner 18 to expand the top of it and seal 34 against the bell 12. Optionally the swage 26 can be driven past the slips 33 to insure that the top of the liner 18 has the same drift at 40 down to the bell 36. After that expansion is complete a pickup force on the running string 14 opens the bypass 82 on the seal 28 so that a wet string is not pulled when removing the running string 14. A pickup force also allows the swage 26 to collapse so that it will pass easily through the drift dimension 40. After the running string 14 and the equipment it supports removed as shown in FIG. 25, drilling can continue through the cement shoe 60 that is milled up to further extend the monobore well.

Those skilled in the art will appreciate that reference to a liner 18 is intended to include other tubular strings that are initially circular in shape or folded in any way and can include casing or liner or slotted liner or other types of tubular strings and be within the scope of the invention. The method of the present invention guides the swage assembly while driving it with annulus pressure from the surface so that the liner 18 finds initial support. The liner is then released from the running string 14 and the balance of the liner is expanded with pressure onto seal 28 which preferably is a cup seal although other seal arrangements are contemplated. Seal 30 which can be another cup seal or some other type of seal is used to seal off around the top of the liner 18 for the time that its seal 34 is not energized. The conclusion of the expansion to the lower end sees the grabbing of the shoe 60 to allow the swage assembly 20 to exit the liner 18 followed by replacement of the shoe 60 back into the liner 18 so that it can be reset in the liner and the pressure tightness of that connection tested before cementing can begin. After cementing the swage assembly 20 is collapsed and brought through the liner 18 so that the swage ring 26 can be built and driven down with fluid pressure onto seal 28 until the seal 34 is set with further expansion of the top of the liner 18. The running string is pulled and what results is a monobore connection. The cement shoe 60 can then be drilled out as the well is drilled deeper and the method is repeated.

While constructing a monobore is preferred, the method can be used to hang tubular strings that do not result in a monobore.

The above description is illustrative of the preferred embodiment and many modifications may be made by those skilled in the art without departing from the invention whose scope is to be determined from the literal and equivalent scope of the claims below.

We claim:

1. A subterranean completion method, through an existing tubular, comprising:

mounting a swage assembly to a running string;

supporting a tubular string to be expanded on said running string;

mounting a running string seal to close off for a time an annular space around said running string, said annular space formed at least in part between said running string and the existing tubular;

driving said swage assembly into said tubular to be expanded using pressure delivered to said annular space and against said seal;

expanding and securing said tubular to be expanded by said driving.

2. The method of claim 1, comprising:

driving said swage assembly with respect to said running string to expand said tubular to be expanded into the existing tubular.

3. The method of claim 1, comprising:

driving said swage assembly through opposed ends of the tubular to be expanded.

4. The method of claim 1, comprising:

using a plurality of swages of different built diameters for expanding said tubular to be expanded.

5. The method of claim 4, comprising:

building at least one swage in said swage assembly with pressure in said annular space delivered to said seal.

6. The method of claim 1, comprising:

providing an end seal on said tubular to be expanded that contacts the existing tubular or open hole to hold pressure in said annular space after said running string seal enters said tubular to be expanded.

7. The method of claim 1, comprising:

producing a monobore connection by said expanding and securing.

8. The method of claim 1, comprising:

mounting an anchor to said running string to selectively engage the existing tubular or open hole;

providing an end seal on said tubular to be expanded that contacts the existing tubular or open hole to hold pressure in said annular space after said running string seal enters said tubular to be expanded;

engaging said anchor to the existing tubular or open hole with pressure in said annular space around said running string acting on said running string seal and said end seal.

9. The method of claim 8, comprising:

releasing said anchor after said expanding and securing;

increasing the size of said swage assembly while said swage assembly is located in the tubular to be expanded and at a location below an end of the existing tubular;

driving said swage assembly in the increased size of said swage assembly with pressure in said annular space around said running string acting on said running string seal.

10. The method of claim 1, comprising:

providing a travel stop on said running string;

automatically opening a bypass for said running string seal when said swage assembly engages said travel stop and closing said bypass when said swage assembly is out of contact with said travel stop.

11. The method of claim 1, comprising:

releasing said string to be expanded from the running string after said expanding and securing;

providing a travel stop on said running string;

releasing as a result of said swage assembly engaging said travel stop.

12. The method of claim 1, comprising:

expanding at least a first portion of said tubular to be expanded to a first dimension with said expanding and securing;

subsequently expanding a second portion of said tubular to be expanded to a larger dimension;

using at least two adjustable swages for expanding said first and second portions.

13. The method of claim 12, comprising:

increasing the dimension of the tubular to be expanded when building a larger of said at least two adjustable swages;

providing an end seal on said tubular to be expanded that contacts the existing tubular or open hole to hold pressure in said annular space after said running string seal enters said tubular to be expanded;

using pressure in said annular space around said running string and against said running string seal and said end seal to build said swages.

14. The method of claim 13, comprising:

using at least three adjustable swages at different times that have different sizes;

initially expanding and securing with a first swage to engage at least one slip to the existing tubular;

subsequently expanding the tubular to be expanded below where there is overlap with the existing tubular with a second swage that builds to a larger diameter than said first swage;

positioning said swages at an end of said tubular that is now initially expanded and building said third swage to a larger dimension than the built dimension of said second swage;

securing a seal adjacent said slip to the existing tubular.

15. The method of claim 14, comprising:

passing said third swage when built past said seal and said slip.

16. The method of claim 1, comprising:

driving said swage assembly in tandem with said running string to expand said tubular to be expanded into the existing tubular.

17. The method of claim 1, comprising:

driving said swage assembly through said tubular to be expanded from top to bottom.

18. The method of claim 1, comprising:

using a single swage that can be built to a plurality of expansion dimensions as said swage assembly.

19. A subterranean completion method, through an existing tubular, comprising:

mounting a swage assembly to a running string;

supporting a tubular string to be expanded on said running string;

mounting a running string seal to close off for a time an annular space around said running string, said annular space formed at least in part between said running string and the existing tubular;

driving said swage assembly into said tubular to be expanded using pressure delivered to said annular space and against said seal;

expanding and securing said tubular to be expanded by said driving;

using a plurality of swages of different built diameters for expanding said tubular to be expanded;

building a second swage of a bigger size than an initial swage used to expand and support said tubular to be expanded to the existing tubular;

expanding said tubular to be expanded with said second swage from where said tubular to be expanded does not overlap the existing tubular and to an end of said tubular to be expanded.

20. The method of claim 19, comprising:

building said second swage while said second swage is in said tubular to be expanded;

using pressure in said annular space against said running string seal to build said second swage providing an end seal on said tubular to be expanded that contacts the existing tubular or open hole to hold pressure in said annular space after said running string seal enters said tubular to be expanded.

21. The method of claim 19, comprising:

engaging a cement shoe with said swage assembly as said swage assembly advances toward said end of said tubular to be expanded;

advancing said cement shoe beyond said end of said tubular to be expanded as said swage assembly exits said end of said tubular to be expanded;

sealingly engaging said cement shoe to the now expanded lower end;

delivering cement through said running string that is engaged through said cement shoe and into a second annular space around the now expanded tubular.

22. The method of claim 21, comprising:

releasing said work string from said cement shoe after said delivering;

retracting said swage assembly through said now expanded tubular;

building a third swage that is bigger than said second swage outside said now expanded tubular;

engaging said third swage to said now expanded tubular;

setting an exterior seal between said now expanded tubular and the existing tubular or open hole by further expanding with said third swage.

23. The method of claim 22, comprising:

building said third swage with pressure in said running string;

running said third swage into said now expanded tubular past the location of exterior slips that support the now expanded tubular to the existing tubular.

* * * * *